US009899787B2

(12) United States Patent
Baumler

(10) Patent No.: US 9,899,787 B2
(45) Date of Patent: Feb. 20, 2018

(54) APPARATUS AND METHODS FOR CONNECTING AND DISCONNECTING THREADED CONNECTORS

(71) Applicant: L-3 Communications Integrated Systems L.P., Greenville, TX (US)

(72) Inventor: Richard Baumler, Heath, TX (US)

(73) Assignee: L-3 Communications Integrated Systems L.P., Greenville, TX (US)

( * ) Notice: Subject to any disclaimer, the term of this patent is extended or adjusted under 35 U.S.C. 154(b) by 601 days.

(21) Appl. No.: 14/325,268

(22) Filed: Jul. 7, 2014

(65) Prior Publication Data

US 2016/0006204 A1 Jan. 7, 2016

(51) Int. Cl.

| | |
|---|---|
| ***H01R 43/26*** | (2006.01) |
| ***B25B 13/48*** | (2006.01) |
| ***B25B 17/00*** | (2006.01) |
| ***B25B 13/08*** | (2006.01) |

(52) U.S. Cl.

CPC ..... *H01R 43/26* (2013.01); *B25B 13/08* (2013.01); *B25B 13/481* (2013.01); *B25B 17/00* (2013.01)

(58) Field of Classification Search

CPC ..... H01R 43/26; B25B 13/00; B25B 13/08; B25B 13/481; B25B 17/00; Y10T 29/53257; Y10T 29/53283

See application file for complete search history.

(56) References Cited

U.S. PATENT DOCUMENTS

| | | | | |
|---|---|---|---|---|
| 4,928,558 | A * | 5/1990 | Makhlouf | B25B 13/481 81/57.13 |
| 5,460,062 | A * | 10/1995 | Wilson, Jr. | B25B 13/48 81/56 |
| 7,080,581 | B2 | 7/2006 | Reese | |
| 8,690,602 | B2 | 4/2014 | Flaherty, IV | |
| 2008/0216611 | A1 | 9/2008 | Resnick | |
| 2008/0289460 | A1 | 11/2008 | Whitehead et al. | |

OTHER PUBLICATIONS

Sears, Sunex 7 Piece 1/2 Drive Oxygen Sensor Set, Printed from Internet Apr. 11, 2014, 2 pgs.
Sears, Sunex Tools 2850 7 Piece Oxygen Sensor Socket Set, Printed from Internet Apr. 11, 2014, 2 pgs.
Sears, Gear Wrench 8 Piece Master Oxygen Sensor Socket Kit, Printed from Internet Apr. 11, 2014, 2 pgs.
Sears, 8 Piece Oxygen Sensor Socket Set, Printed from Internet Apr. 11, 2014, 2 pgs.
Sears, Alltrade 948005 Master Sensor Socket Kit-7 Piece, Printed from Internet Apr. 11, 2014, 2 pgs.

(Continued)

*Primary Examiner* — Peter DungBa Vo
*Assistant Examiner* — Jeffrey T Carley
(74) *Attorney, Agent, or Firm* — Egan Peterman Enders Huston

(57) ABSTRACT

Apparatus and methods that may be employed to install or remove a threaded connector by allowing a cable or tubing segment attached to the threaded connector to pass through an open pass-through area that is defined to extend through the tool so as to allow the threaded connector to be tightened and/or loosened relative to the fitting by turning the connector a full revolution or more while the cable or tubing is attached to the connector and extending through the tool.

26 Claims, 10 Drawing Sheets

(56) References Cited

OTHER PUBLICATIONS

Sears, Grip 6 Piece SAE Flare Nut Brake Fuel Line Wrench Set, Prnted from Internet Apr. 11, 2014, 2 pgs.
Sears, Sunex Universal Oxygen Sensor Socket, Printed from Internet Apr. 11, 2014, 2 pgs.
Sears, ATE Pro Tools USA Auto Oxygen Sensor & Sending Unit Kit 7 Piece Socket Set, Printed from Internet Apr. 11, 2014, 2 pgs.
Sears, OTC 7 Piece Oxygen Sensor Socket Set, Printed from Internet Apr. 11, 2014, 2 pgs.
Sears, Ez Red 4 Piece Metric Ratcheting Line Wrench Set (8 Sizes), Printed from Internet Apr. 11, 2014, 2 pgs.
Sears, Horizon Tool Inc 843 Oxygen Sensor Wrench, Printed from Internet Apr. 11, 2014, 2 pgs.
Sears, Flexible Oxygen Sensor Wrench, Printed from Internet Apr. 11, 2014, 2 pgs.
Thomasnet, Coax Connector Tool Assists Datacom Technicians, Printed from Internet Apr. 11, 2014, 2 pgs.

* cited by examiner

APPARATUS AND METHODS FOR CONNECTING AND DISCONNECTING THREADED CONNECTORS

FIELD OF THE INVENTION

This invention relates generally to apparatus and methods that may be used to connect and disconnect threaded connectors and, more particularly, to apparatus and methods that may be used to connect threaded connectors to threaded fittings and to disconnect threaded connectors from threaded fittings.

BACKGROUND

Threaded connectors are used for connecting radio frequency (RF) coaxial cables to mating stationary RF connectors. Examples of such threaded RF coaxial connectors include hex F compression connectors, Subminiature version A (SMA) connectors, reverse polarity SMA (RSMA) connectors, Subminiature version C (SMC) connectors, and SSMA connectors. Often multiple RF coaxial cables are connected to stationary RF connectors in adjacent relationship to each other. Open-ended wrenches have been used in the past to engage and turn a threaded RF connector relative to a corresponding stationary threaded fitting so as to connect or disconnect the RF connector and its RF coaxial cable from the stationary RF fitting. Where multiple threaded connectors and fittings are engaged next to each other, the range of motion of an open-end wrench to rotate a given connector is physically limited by the presence of adjacent connectors and RF coaxial lines. Thus, when connecting and disconnecting threaded RF coaxial electrical connectors in close adjacent relationship to each other, an open-end wrench often can often only be rotated by about ⅓ of a turn at time due to interference from adjacent connected RF coaxial cables. Range of motion of an open-ended wrench can also be limited in other hard to access locations.

SUMMARY OF THE INVENTION

Disclosed herein are apparatus and methods that may be employed to engage and rotate threaded connectors, e.g., so as to connect a threaded connector to a corresponding threaded fitting and/or to disconnect a threaded connector from a corresponding threaded fitting. Examples of such connectors include, but are not limited to, threaded connectors configured to couple electrical or electronic cables (e.g., threaded RF coaxial cable connectors) to corresponding electrical or electronic fittings, threaded tubing connectors configured to couple tubing (e.g., hydraulic tubing, pneumatic tubing, fuel injection tubing) to threaded tubing fittings, etc. Advantageously, the disclosed apparatus and methods may be employed in one embodiment to engage and rotate threaded connectors relative to threaded fittings to install the connectors to the fittings and remove the connectors from the fittings in hard to access locations, e.g., such as in locations where threaded connectors and fittings are engaged next to each other in close spaced relationship. The disclosed apparatus and methods may be employed to install and/or remove threaded connectors in reduced time relative to conventional methods and apparatus.

In one exemplary embodiment, a connection and disconnection tool apparatus may be provided that is configured to install or remove a threaded connector (e.g., threaded electrical or electronic coaxial connector, threaded tubing connector, etc.) together with an attached cable or tubing to a corresponding threaded fitting in a hard to access location by allowing the attached cable or tubing to pass through an open pass-through area defined to extend through the tool so as to allow the threaded connector to be tightened and/or loosened relative to the fitting by turning the connector a full revolution or more while the cable or tubing is attached to the connector and extending through the tool. Such a connection and disconnection apparatus may be advantageously configured in one embodiment to be operated by a user from a remote location or position that provides greater user access during operation of the tool.

In one exemplary embodiment, a connection and disconnection tool may be provided that has an offset drive mechanism that rotationally couples a user-side axis of rotation to a connector-side axis of rotation so as to allow a user to provide an input rotational motion (e.g., by rotating a handle) to the user-side axis of rotation that is translated by the offset drive mechanism to an output rotational motion from the connector-side axis of rotation, e.g., to rotate a threaded connector one or more full revolutions (by 360 degrees or more) at the same time that a cable or tubing segment is extending through the tool in a position that is coincident with the connector-side axis of rotation, and without any mechanical interference between the cable or tubing segment and the tool as the threaded connector is rotated, e.g., without any winding of an attached cable around rotating parts of the tool and without any mechanical binding between of an attached tubing and rotating parts of the tool. The offset drive mechanism may include, for example, drive gears configured to translate rotation motion between a user-side axis of rotation that is parallel to a connector-side axis of rotation.

In one embodiment, a user-side drive interface (e.g., such as a rotatable handle or fitting for mating with a power drive such as electric screwdriver or electric drill) may be provided to allow a user to input rotational motion to the user-side axis of rotation. In another embodiment, an integral actuator (e.g., electric motor, pneumatic actuator, hydraulic actuator, etc.) may be provided as an integral part of the tool so as to impart drive motion without need for external drive to be applied to the tool.

In one exemplary embodiment, a connector connection and disconnection tool may be configured to extend outward and away from the location of the connector so as to allow a user to operate the tool to rotate the connector while the user remains at a distance spaced away from the connector where the user may have greater access to manipulate or otherwise apply rotational drive motion to the user-side drive interface, e.g., such as where multiple adjacent connectors are grouped together in close proximity in a manner that would otherwise interfere with engaging and/or rotating the connector. In this regard, a user-side drive interface component may be elongated to impart spacing between the offset drive mechanism and a terminal end of the user-side drive interface component, and/or a connector-side drive interface component may be elongated to impart spacing between the offset drive mechanism and a terminal end of the user-side drive interface component when the connector-side drive interface component is engaged to rotate the connector. For example, a user-side drive interface component may be configured as an elongated handle or other suitable type of elongated user-side drive component so as to create a space between the offset drive mechanism and the user while the user is operating the tool. Likewise, a connector-side drive interface component may be configured to include an elongated portion in the form of a spacer segment that extends along the connector-side axis of rotation in a direction away from the offset drive mechanism and toward the connector so as to create a space between the offset drive mechanism and the connector.

In one exemplary embodiment, a connector-side drive interface component may be configured as a first spanner that is configured with one or more connector engagement features to lockingly engage the exterior flat surfaces of a threaded connector so as to hold the threaded connector as the first spanner is rotated by an offset drive mechanism and thus impart rotation to the threaded connector. The first spanner of the connector-side drive interface component may be coupled to the offset drive mechanism by a first spacer segment as either a single-piece or multiple-piece connector-side drive interface component. The first spanner, offset drive mechanism and the first spacer segment may be provided with respective side-accessible open pass-through areas that are aligned with each other to allow an attached cable or tubing to be inserted into engagement with the first spanner, offset drive mechanism and the first spacer segment to a position that is coincident with the connector-side axis of rotation. In one exemplary embodiment, a modular connector-side drive interface may be provided, e.g., the first spanner together with its first spacer segment (when present) may be provided as a modular connector-side drive interface component that is removable from the offset drive mechanism so that interchangeable connector-side drive interface components (e.g., first spanner components) of different dimensions to lockingly engage threaded members having different outside dimensions and/or shapes.

In a further embodiment, an optional backup interface component may be provided that is configured to lockingly engage the exterior flat surfaces of an underlying backup fastener that is positioned adjacent and in-line with the threaded connector (e.g., that is threaded on the same threaded member) so as to prevent the backup fastener from rotating while the threaded connector is being rotated by the connector-side drive interface component. A backup interface component may be configured in one embodiment as a second spanner that is configured with one or more connector engagement features to lockingly engage the exterior flat surfaces of a backup fastener so as to hold the backup fastener stationary as the first spanner is rotated by an offset drive mechanism.

A backup interface component may in one embodiment include a second spanner that is coupled by a second spacer segment to a housing or other structure that supports or houses the offset drive mechanism. Such a second spacer segment may be configured to position the second spacer into locking engagement with the backup fastener while the first spanner is positioned in locking engagement with the threaded connector. In one exemplary embodiment, the second spacer and its second spanner may be configured to pivot outward and away from the first spacer and its first spanner to facilitate ease of installation and removal of the first spanner in locking engagement with the threaded connector. In another exemplary embodiment, the second spacer and its second spanner may be configured to rotate around the connector-side axis of rotation relative to the offset drive mechanism, e.g., in order to match the clocking of a threaded backup nut or other fastener that may be positioned in-line and beneath the threaded connector.

In one respect, disclosed herein is a connection and disconnection tool apparatus, including: an offset drive mechanism configured to mechanically translate rotational motion from a user-side axis of rotation to a connector-side axis of rotation, the user-side axis of rotation being different than the connector-side axis of rotation; a user-side drive interface component configured to be coupled to provide an input rotational motion to the user-side axis of rotation of the offset drive mechanism; and a connector-side drive interface component having one or more connector engagement features and configured to be coupled to receive an output rotational motion from the connector-side axis of rotation of the offset drive mechanism and to rotate in response to the received output rotational motion. The connector-side drive interface component and the offset drive mechanism may each have a side-accessible pass-through area defined therein that includes a peripheral opening contiguous with an axial open portion that is coincident with the connector-side axis of rotation, the pass-through area of the connector-side drive interface component being configured to be aligned with the pass-through area of the offset drive mechanism.

In another respect, disclosed herein is a method of rotating a threaded connector having an attached cable or tubing segment, including: lockingly engaging a connector-side drive interface component of a connection and disconnection tool apparatus to the threaded connector having one or more connector engagement features; rotating a user-side drive interface component of the connection and disconnection tool apparatus to provide an input rotational motion to a user-side axis of rotation of an offset drive mechanism of the connection and disconnection tool apparatus; mechanically translating rotational motion in the offset drive mechanism from the user-side axis of rotation to a connector-side axis of rotation, the user-side axis of rotation being different than the connector-side axis of rotation; and receiving an output rotational motion from the connector-side axis of rotation of the offset drive mechanism to cause the connector-side drive interface component to rotate the threaded connector in response to the received output rotational motion. The method may further include: placing the attached cable or tubing segment of the threaded connector into a position coincident with the connector-side axis of rotation within an axial open portion of a side-accessible pass-through area defined in the connector-side drive interface component and an axial open portion of a side-accessible pass-through area defined in the offset drive mechanism by passing the attached cable or tubing segment through a respective peripheral opening that is contiguous with the axial open portion of each of the side-accessible pass-through areas of each of the connector-side drive interface component and the offset drive mechanism, the pass-through area of the connector-side drive interface component being aligned with the pass-through area of the offset drive mechanism; and causing the connector-side drive interface component to rotate the threaded connector in response to the received output rotational motion while the cable or tubing segment is received in the position coincident with the connector-side axis of rotation within the side-accessible pass-through openings of the connector-side drive interface component and the offset drive mechanism.

In another respect, disclosed herein is a connection and disconnection tool apparatus, including: an offset drive mechanism configured to mechanically translate rotational motion from a user-side axis of rotation to a connector-side axis of rotation, the user-side axis of rotation being different than the connector-side axis of rotation; a user-side drive interface component including a first spanner coupled to provide an input rotational motion to the user-side axis of rotation of the offset drive mechanism, the first spanner having interior connector engagement surfaces defined therein, the first spanner being aligned with the connector-side axis of rotation, and the interior connector engagement surfaces being shaped and dimensioned complementary to one or more external surfaces of a threaded connector; and a connector-side drive interface component having one or more connector engagement features and coupled to receive an output rotational motion from the connector-side axis of rotation of the offset drive mechanism and to rotate in response to the received output rotational motion. The connector-side drive interface component may further include a first spacer segment coupled between the offset drive mechanism and the first spanner, the first spacer segment being coupled to receive the output rotational motion from the connector-side axis of rotation of the offset drive mechanism and to transfer the output rotational motion to the first spacer. The connector-side drive interface component and the offset drive mechanism may each have a side-accessible pass-through area defined therein that includes a peripheral opening contiguous with an axial open portion that is coincident with the connector-side axis of rotation, the pass-through area of the connector-side drive interface component being aligned with the pass-through area of the offset drive mechanism. The connector engagement features of the connector-side drive interface may be configured to lockingly engage an exterior profile of a threaded connector so as to hold the threaded connector as the connector-side drive interface is rotated by the rotational motion received from the offset drive mechanism so as to impart rotation to the threaded connector while a cable or tubing segment that is attached to the threaded connector is received in a position coincident with the connector-side axis of rotation within the side-accessible pass-through openings of the connector-side drive interface component and the offset drive mechanism.

DESCRIPTION OF ILLUSTRATIVE EMBODIMENTS

Figure 1:
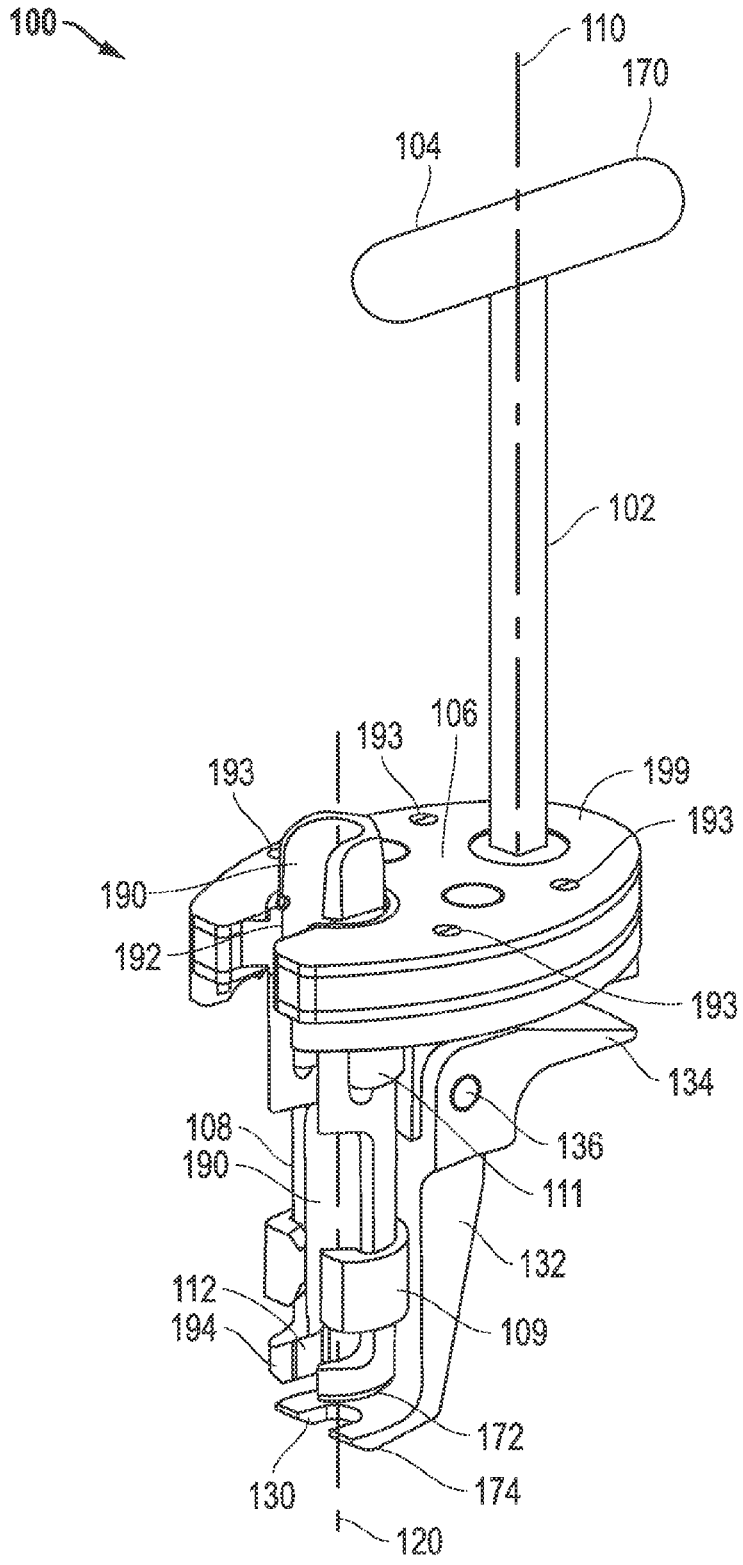
FIG. 1 illustrates a perspective view of a connection and disconnection tool apparatus according to one exemplary embodiment of the disclosed apparatus and methods.
Figure 2:
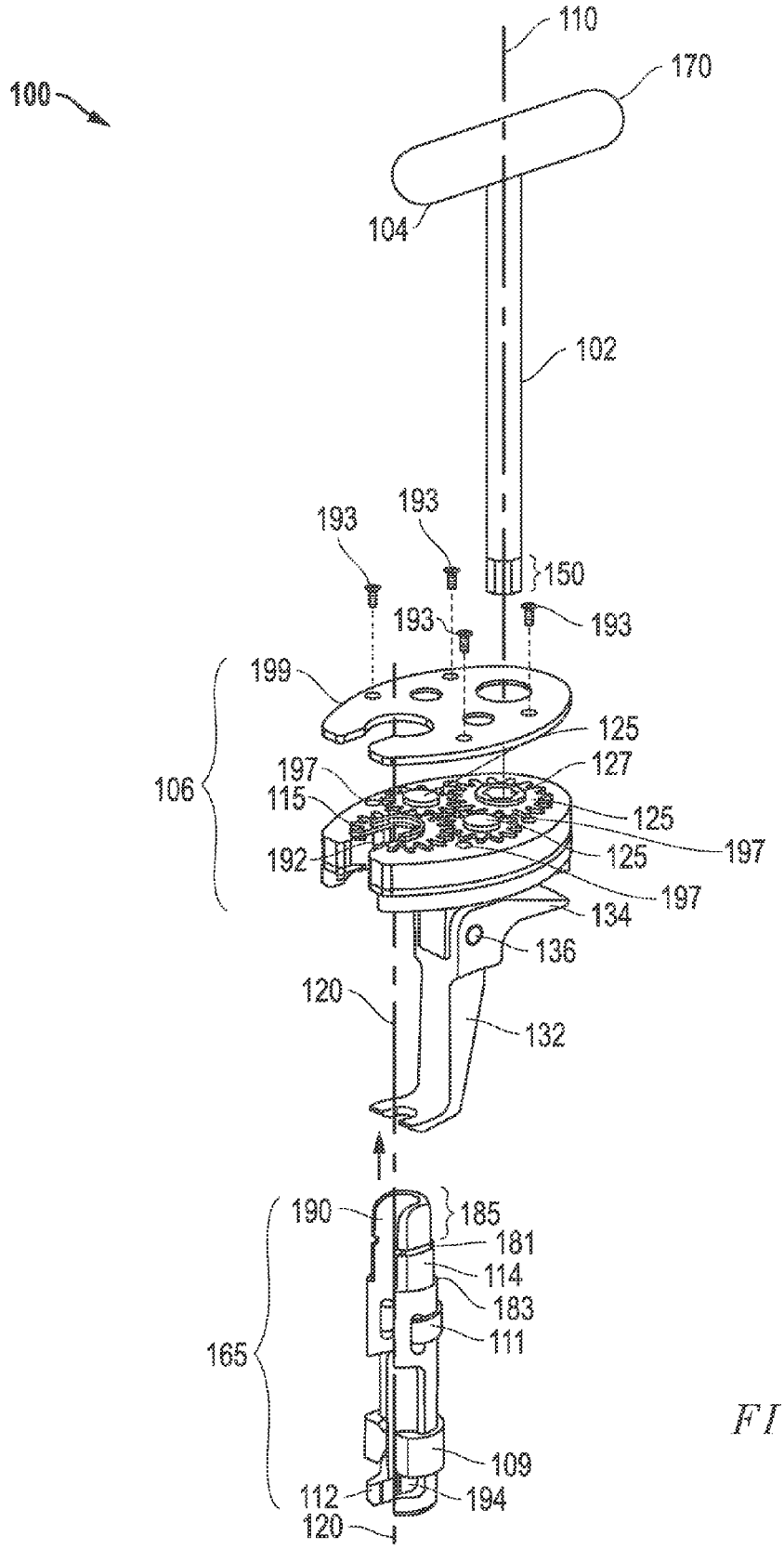
FIG. 2 illustrates an exploded perspective view of a connection and disconnection tool apparatus according to one exemplary embodiment of the disclosed apparatus and methods.

FIGS. 1-2 illustrate one exemplary embodiment of a connection and disconnection tool apparatus 100 that includes an offset drive mechanism 106 that rotationally couples a user-side drive interface component in the form of a rotatable handle 104 and handle extension member 102 to a connector-side drive interface component that in this embodiment includes a first spacer segment 108 and a first spanner 112 provided on a distal end of the connector-side drive interface. In the embodiment of FIGS. 1-2, the user-side drive interface component extends along a user-side axis of rotation 110 and the connector-side drive interface component extends along a connector-side axis of rotation 120 as shown. Overall length of each of a user-side drive interface component and connector-side drive interface component may be selected to provide a desired stand-off distance from a threaded connector. As shown, user-side axis of rotation 110 may be parallel to connector-side axis of rotation 120, although it is also possible that user-side axis of rotation 110 may be angled and/or adjustable relative to connector-side axis of rotation 120 for facilitating access to a threaded connector, e.g., such as by providing a universal joint or other type of adjustable-angled connection/s in-line with the axis of rotation of either or both of the user-side drive interface component and connector-side drive interface component.

As described further herein, offset drive mechanism 106 rotationally couples the user-side axis of rotation 110 to the connector-side axis of rotation 120 of tool 100 so as to allow a user to provide an input rotational motion to the user-side axis of rotation 110 that is translated by the offset drive mechanism 106 to an output rotational motion from the connector-side axis of rotation 120. In one embodiment a human user may hold the offset drive mechanism 106 stationary with one hand, while using the other hand to input rotational motion to the user-side axis of rotation, in this embodiment by rotating handle 104 and extension member 102.

In the exploded view of the embodiment of FIG. 2, internal drive gears 125 of offset drive mechanism 106 are visible beneath an optional drive mechanism cover 199 that is shown detached from offset drive mechanism 106 after removal of cover-retaining fasteners 193 (e.g., screws) from fastener holes 197. In the illustrated embodiment the internal drive gears 125 are configured as a gear system to translate rotation motion between the user-side axis of rotation 110 to the connector-side axis of rotation 120, although any other configuration of drive mechanism components (e.g., such as gear systems having other combinations of gears and/or belt and pulleys rotatably connecting the user-side axis of rotation 110 to the connector-side axis of rotation 120) may be employed in other embodiments. Moreover, an offset drive mechanism may be configured to provide rotation to a connector-side drive interface component relative to a user-side drive interface component in any suitable ratio. For example, offset drive mechanism may be configured to provide a 1:1 ratio (one full turn of user-side drive interface component is translated to one full turn of connector-side drive interface component) or to provide any other suitable greater or lesser ratio, e.g., such as 0.5:1 ratio (one-half turn of user-side drive interface component is translated to one full turn of connector-side drive interface component), 1:0.5 ratio (one full turn of user-side drive interface component is translated to one-half turn of connector-side drive interface component), etc.

As further illustrated in exploded view of FIG. 2, a user-side drive interface component may be optionally configured in one embodiment to be detachable from offset drive mechanism 106 and may include mating drive features 150, e.g., in the form of flat surfaces or other suitable features defined on the terminal end of handle extension member 102 that are dimensioned and configured to engage complementary mating drive features 129 defined within a drive receptacle 127 of offset drive mechanism 106 in order transmit drive motion from the user-side drive interface component to the offset drive mechanism 106. In such an optional configuration, a user-side drive interface component may be so removable to allow more compact storage and/or better ease of installation in situations where space is limited. Moreover, provision of mating drive features 129 defined within a drive receptacle 127 of offset drive mechanism 106 may optionally allow for selection and interchanging of different user-side drive interface components, e.g., rotatable handle, motor-driven rotating shank of a power tool such as electric drill or electric screw driver, etc.

As further shown in FIGS. 1-2, first spanner 112 is provided with an open area 194 for receiving a threaded connector therein and interior connector engagement features in the form of surfaces or profile defined within the open area that are configured to mate with and lockingly engage the exterior flat surfaces of a threaded connector so as to hold the threaded connector while the first spanner 112 is rotated by the offset drive mechanism 106 so as to impart rotation to an engaged threaded connector. In this regard first spanner 112 may be provide with any configuration of interior engagement surfaces that is suitable for engaging exterior surfaces of a threaded connector, including threaded connectors having one or more flat exterior surfaces or other shape or configuration of exterior surfaces. In this regard, interior connector engagement surfaces of a first spanner 112 may be of any suitable configuration for lockingly engaging exterior surfaces of a corresponding threaded connector, e.g., such as having a profile similar to an open-end wrench or socket that is complementary in shape and size or dimension to the outer flat surfaces of a threaded connector. Still referring to FIGS. 1-2, the first spanner 112 is coupled in this embodiment to the offset drive mechanism 106 by the spacer segment 108. It will be understood that a first spacer segment 108 is optional, and that in another embodiment a first spanner 112 may alternatively be coupled directly to offset drive mechanism 106 with no spacer segment 108 therebetween. Example of types of threaded connectors for which a first spanner 112 may be configured to lockingly engage include, but are not limited to, threaded RF coaxial connectors (e.g., such as Hex F, SMA, RSMA, SMC, SSMA connectors); oxygen sensor connectors, hydraulic tubing connectors (e.g., such as brake line connectors) or pneumatic tubing connectors, etc.

Figure 9A:
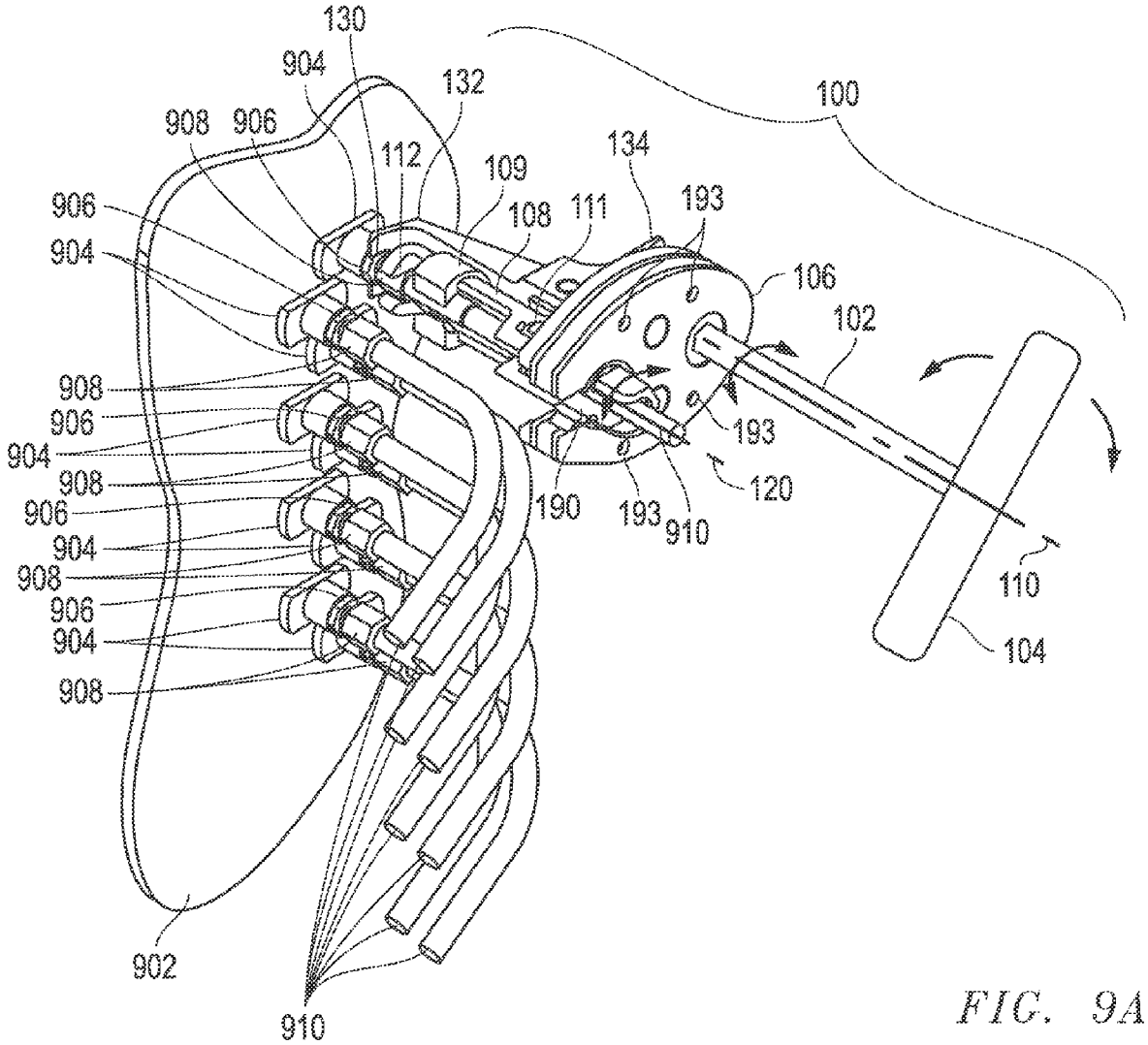
FIG. 9A illustrates a connection and disconnection tool apparatus lockingly engaged with a first threaded connection according to one exemplary embodiment of the disclosed apparatus and methods.

As illustrated, the spacer segment 108, the offset drive mechanism 106, and the first spanner 112 may be provided with corresponding respective side-accessible open pass-through areas 190, 192 and 194 that each have a peripheral (or side) opening that is contiguous with an axial open portion. As shown, the respective peripheral openings and axial open portions of pass-through areas 190, 192 and 194 may be aligned with each other so as to allow a cable or tubing together with an attached threaded connector to be inserted from the side until the threaded connector is positioned in locking engagement with the first spanner 112, with the attached cable or tubing 910 extending coincident with the connector-side axis of rotation 120 through the spacer segment 108 and the offset drive mechanism 106 as shown in FIG. 9A while the offset drive mechanism rotates the first spanner 112 and spacer segment 108.

Figure 6:
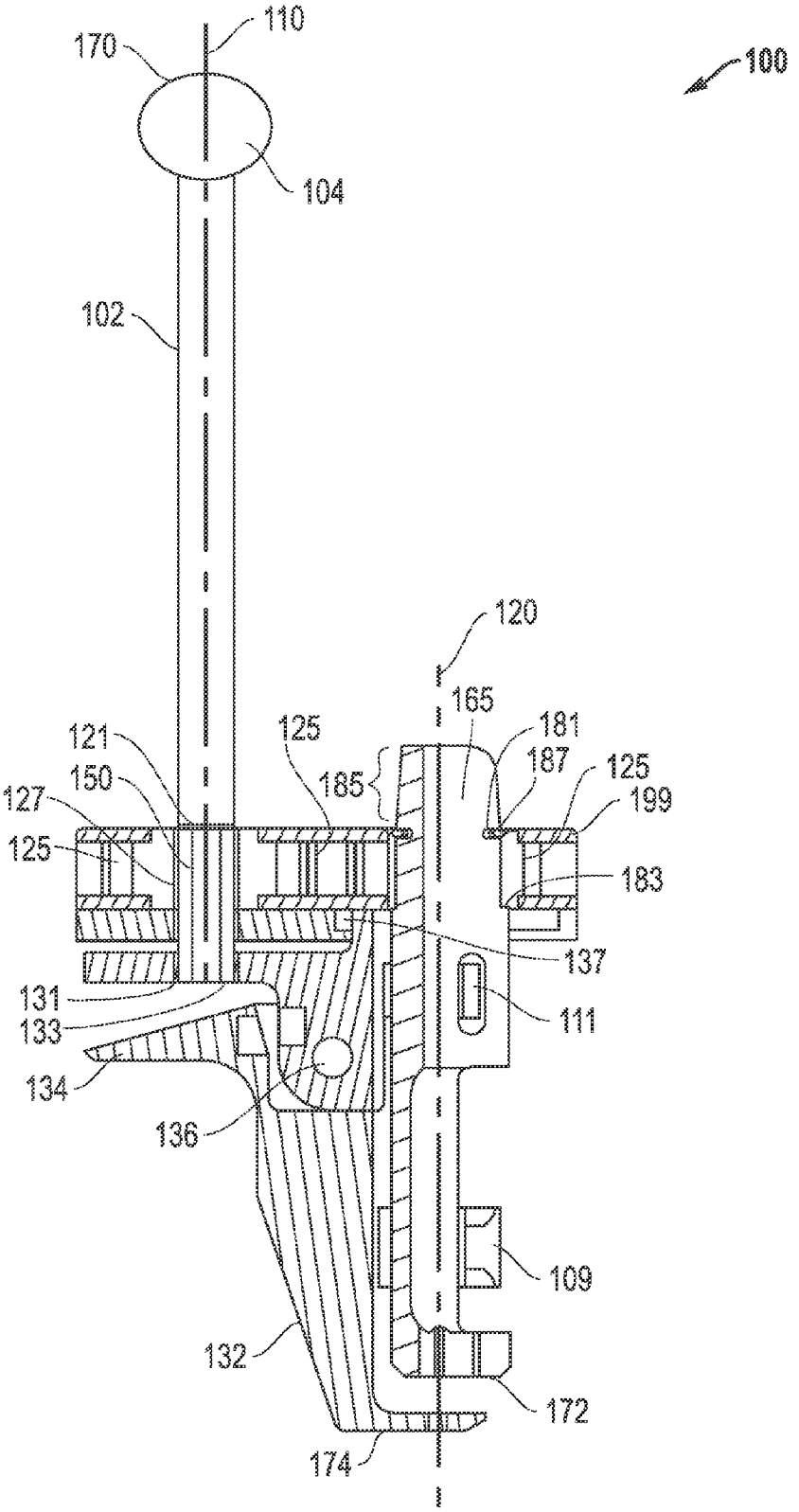
FIG. 6 illustrates a side cross-sectional view of a connection and disconnection tool apparatus according to one exemplary embodiment of the disclosed apparatus and methods.

As illustrated in FIG. 2, the first spanner 112 may be optionally provided together with its first spacer segment 108 (when optionally present) as a modular connector-side interface component 165 that is removable from the offset drive mechanism so that different modular connector-side interface components 165 having different size and/or shape first spanner components 112 may be interchanged within a rotatable spanner module receptacle 115 that may be defined in offset drive mechanism 106, e.g., by inserting and locking a given modular connector-side interface component 165 in place within rotatable spanner receptacle 115. The different first spanner components 112 of such interchangeable spanner module components 165 may be configured with internal connector engagement surfaces of different dimensions from each other so as to lockingly engage threaded connector members having different outside dimensions and/or shapes. In the illustrated embodiment, a modular component 165 may be inserted into receptacle 115 of offset drive mechanism 106 from below with a locating shoulder 183 provided on modular component 165 to prevent upwards over-travel of modular component 165. In such an embodiment modular component may be temporarily locked within rotatable receptacle 115 via a snap ring 187 of receptacle 115 that is received within a mating groove 181 of modular component 165 as shown in cross-section in FIG. 6. A proximal end of modular connector-side interface component 165 may include an optional extension segment 185 that protrudes above the top of offset drive mechanism 106 to allow modular component 165 to be manually pushed downward by the hand or fingers of a user to disengage modular component 165 for removal from locking engagement within receptacle 115.

In another embodiment, interchangeable first spanner components 112 may be alternatively provided to attach and detach from the terminal or distal end of a separate first spacer segment 108, while spacer segment 108 remains engaged within rotatable receptacle 115 of offset drive mechanism 106. In any case, it will be understood that a modular component 165, spacer segment 108, and/or spanner component 112 may be temporarily or permanently locked within rotatable receptacle 115 via any suitable securement mechanism e.g., via mating threads, mating pin and groove features, mating snap-on spring and groove features, mating pin and hole features, etc.

In a further embodiment, an optional backup interface component in the form of a second spanner 130 disposed on an optional second spacer segment 132 may be provided as shown. As illustrated, such a second spacer segment 132 may be provided to extend from offset drive mechanism 106 in adjacent relationship to a first spacer segment 108 and first spanner 112 so that second spanner 130 is positioned at a distal end 174 of connection and disconnection tool apparatus 100 in position to lockingly engage and hold stationary the exterior flat surfaces of a backup fastener (e.g., threaded backup nut or other type fastener) that that may be positioned adjacent and in-line with a threaded connector so as to prevent the backup fastener from rotating while the threaded connector is being rotated by the first spanner 112 during threaded connector installation or removal.

Figure 3:
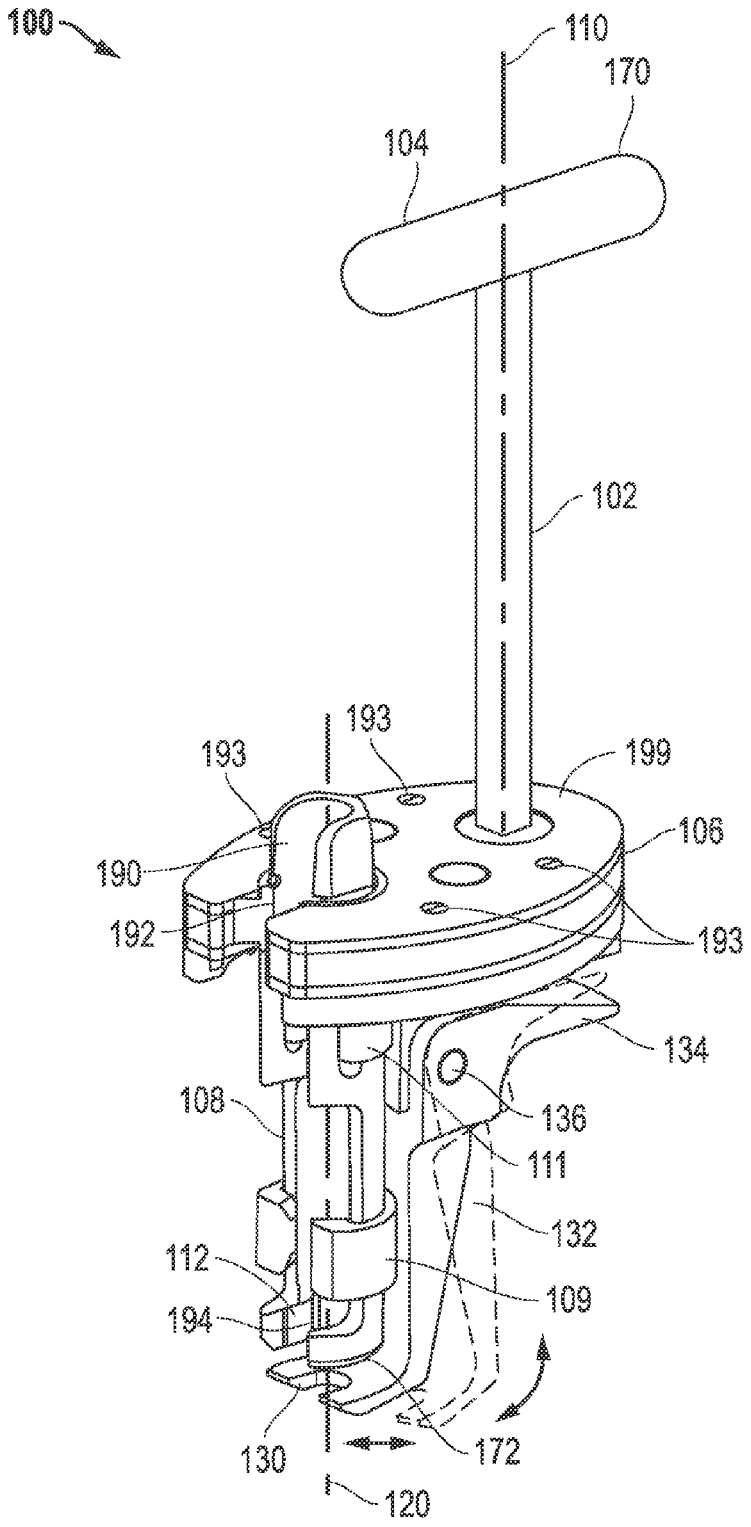
FIG. 3 illustrates a perspective view of a connection and disconnection tool apparatus according to one exemplary embodiment of the disclosed apparatus and methods.
Figure 4:
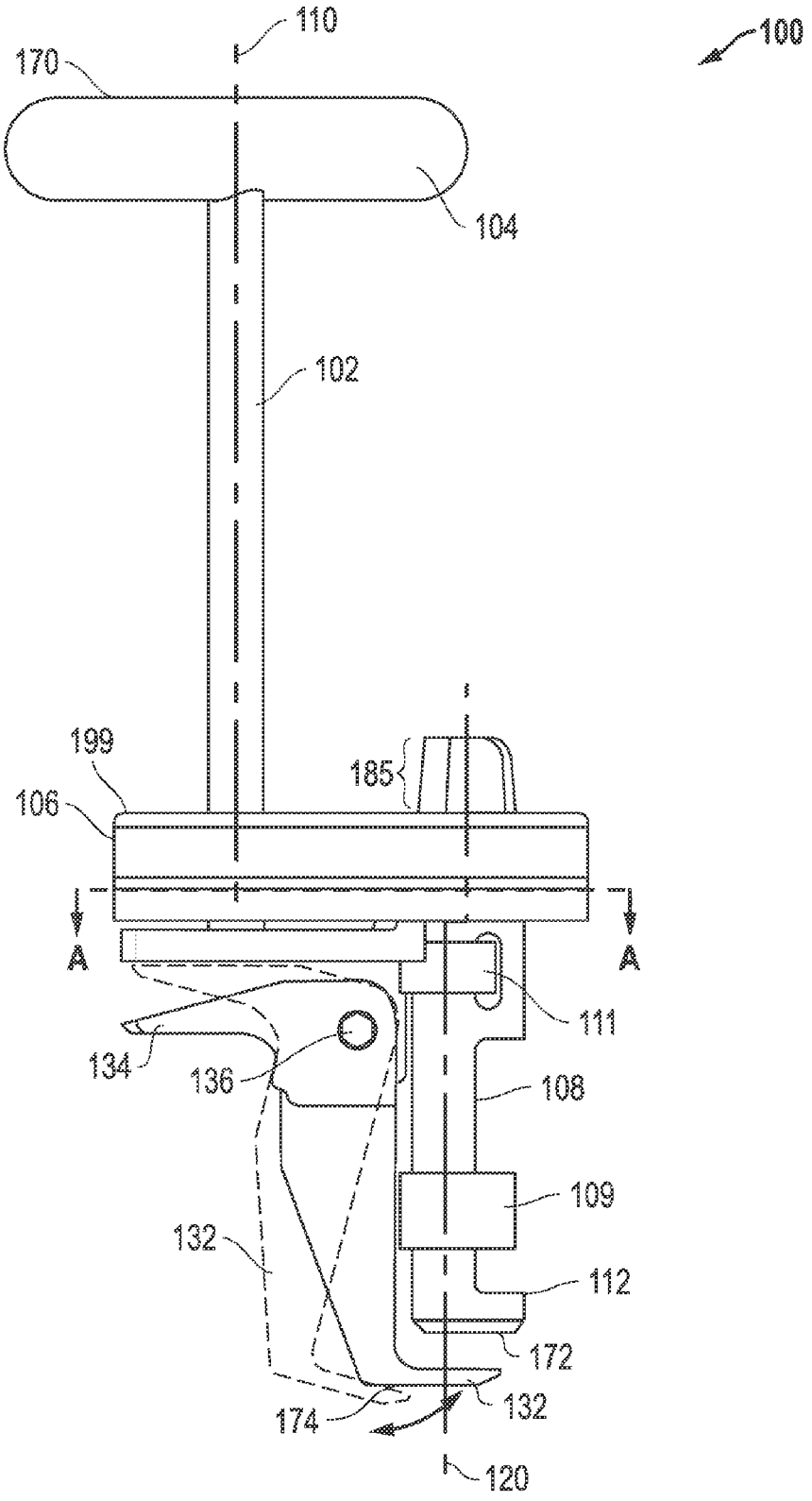
FIG. 4 illustrates a side view of a connection and disconnection tool apparatus according to one exemplary embodiment of the disclosed apparatus and methods.

As illustrated in FIGS. 3 and 4, a second spacer segment 132 may be optionally configured to pivot (e.g., around a pivot point 136) together with its second spanner 130 in a direction outward and away from an adjacent first spacer segment 108 and its first spanner 112 so as to facilitate ease of installation and removal of the first spanner 112 in locking engagement with a threaded connector as shown by the arrows. As further shown in FIGS. 3 and 4, an optional hand grip 134 may be provided on second spacer segment 132 in position to allow a user's hand to manipulate and pivot second spacer 132 and second spanner 130 around pivot point 136.

Figure 5:
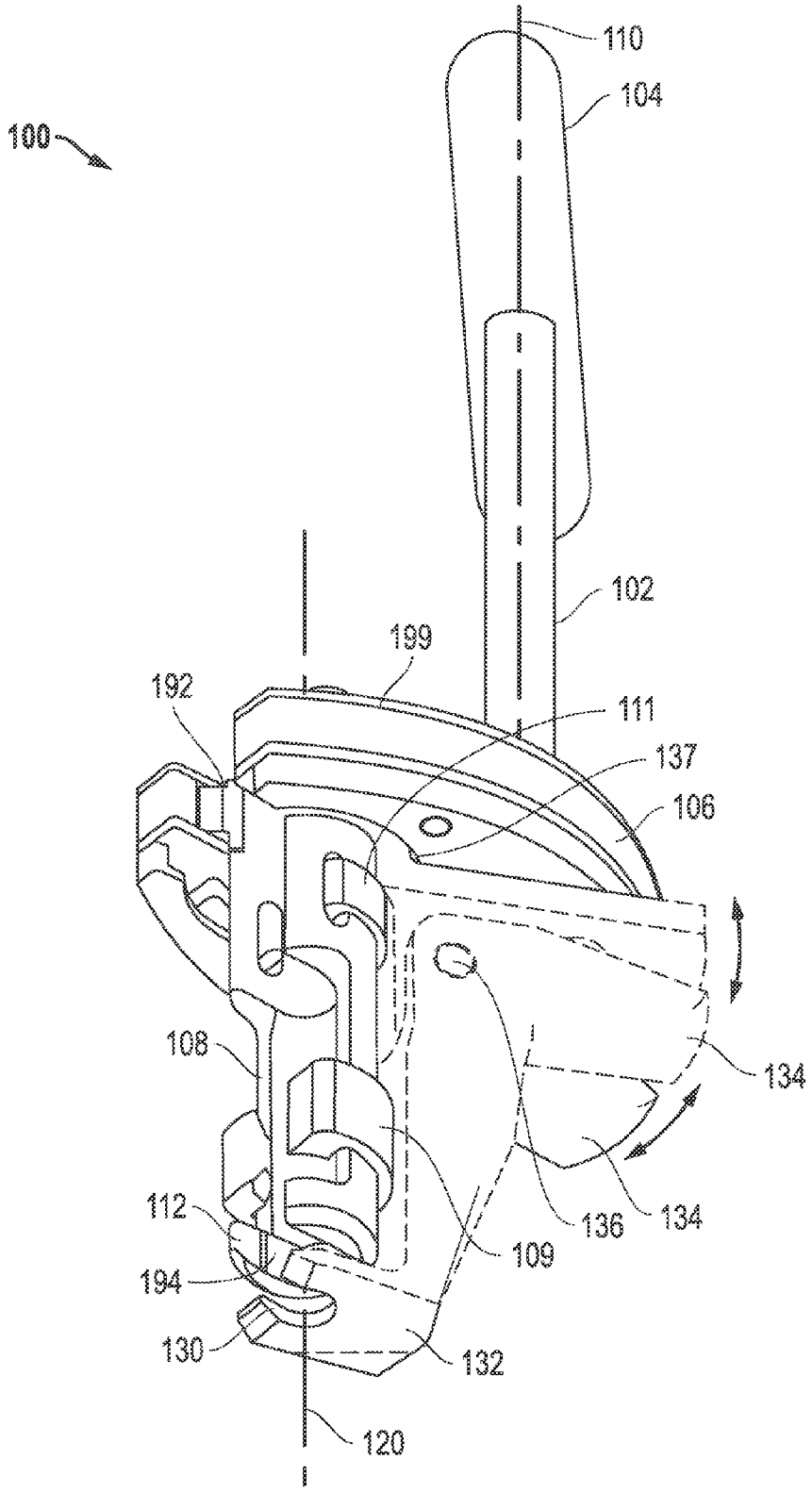
FIG. 5 illustrates a perspective view of a connection and disconnection tool apparatus according to one exemplary embodiment of the disclosed apparatus and methods.

In a further exemplary embodiment illustrated in FIG. 5, such a second spacer segment 132 may be optionally configured to rotate together with its second spanner 130 relative to offset drive mechanism 106 and connector-side drive interface component (e.g., first spanner 112 and first spacer segment 108) in order to match the clocking of a threaded backup nut or other fastener that may be positioned in-line and beneath the threaded connector. For example, in the illustrated embodiment second spacer segment 132 may be coupled to rotate within a groove 137 that may be defined in offset drive mechanism for this purpose. In a further possible embodiment, a spacer segment locking opening 131 may be defined within an upper portion of second spacer segment 132 in a position configured to align beneath drive receptacle 127 of offset drive mechanism 106 such that a terminal or distal end 133 of handle extension member 102 may be inserted through drive receptacle 127 into spacer segment locking opening 131 so as to lock rotatable second spacer segment 132 in place while rotating an engaged threaded connector. When rotation of second spacer segment 132 is desired relative to offset drive mechanism 106, handle extension member 102 may be raised within drive receptacle 127 (or removed from drive receptacle 127 completely) so that handle extension member 102 is no longer received within spacer segment locking opening 131 and second spacer segment 132 is allowed to rotate. In one embodiment, an optional shoulder and/or eternal profile shape transition 121 may be provided as shown to limit insertion distance of handle extension member 102 into drive receptacle 127. Alternatively, spacer segment locking opening 131 may have a bottom surface or internal profile configured to provide mechanical interference to limit insertion distance of handle extension member 102 into spacer segment locking opening 131 and/or to prevent handle extension member 102 from extending completely through spacer segment locking opening 131.

In one exemplary embodiment, an assembled length of a user-side drive interface component (e.g., including rotatable handle 104 and handle extension member 102) as measured from proximal end 170 of the user-side drive interface component to an attached offset drive mechanism 106 may be from about 2 inches to about 12 inches, and an assembled length of a connector-side drive interface component (e.g., including first spanner 112 and spacer segment 108) as measured from distal end 172 of the connector-side drive interface component to the attached offset drive mechanism 106 may be from about 1 inches to about 8 inches, it being understood that greater and lesser lengths of user-side drive interface components and/or connector-side drive interface components are also possible. In another exemplary embodiment, a total assembled end-to-end length of a connection and disconnection tool apparatus 100 as measured from a proximal end of the user-side drive interface component to a distal end 174 of optional connector-side locking component may be from about 4 inches to about 21 inches. However, it will be understood that total assembled end-to-end length of a connection and disconnection tool 100 may alternatively be greater than about 21 inches or less than about 4 inches in other embodiments.

A connector-side drive interface component may be provided in one exemplary embodiment with one or more optional cable or tubing retention features to retain a segment of cable or tubing within side-accessible open pass-through area/s (e.g., such as pass-through areas 190, 192 and 194) while an attached threaded connector is lockingly engaged and rotated by a first spanner such as the illustrated first spanner 112. Referring to the exemplary embodiment of the Figures, two cable or tubing retention features are provided in the form of respective C-shaped leaf spring members 111 and 109 (e.g., bendable steel, plastic, etc.) that each have a retainer opening defined between a pair of spreadable jaws 109*a* and 109*b* or jaws 111*a* and 111*b* (shown in profile in FIGS. 7-8) that is aligned with a peripheral opening of pass-through area 190 so as to allow a segment of cable or tubing 910 shown in FIGS. 9A-9C to be inserted from the side between the jaw pairs 109*a*/109*b* and 111*a*/111*b* into the axial open portion of pass-through areas 190, 192 and 194 in coincident (e.g., substantially parallel) relationship to the connector-side axis of rotation 120 to allow the first spacer segment 108 to rotate around the inserted cable or tubing segment 910 while the first spanner 112 lockingly engages and rotates an attached threaded connector 980.

Figure 9B:
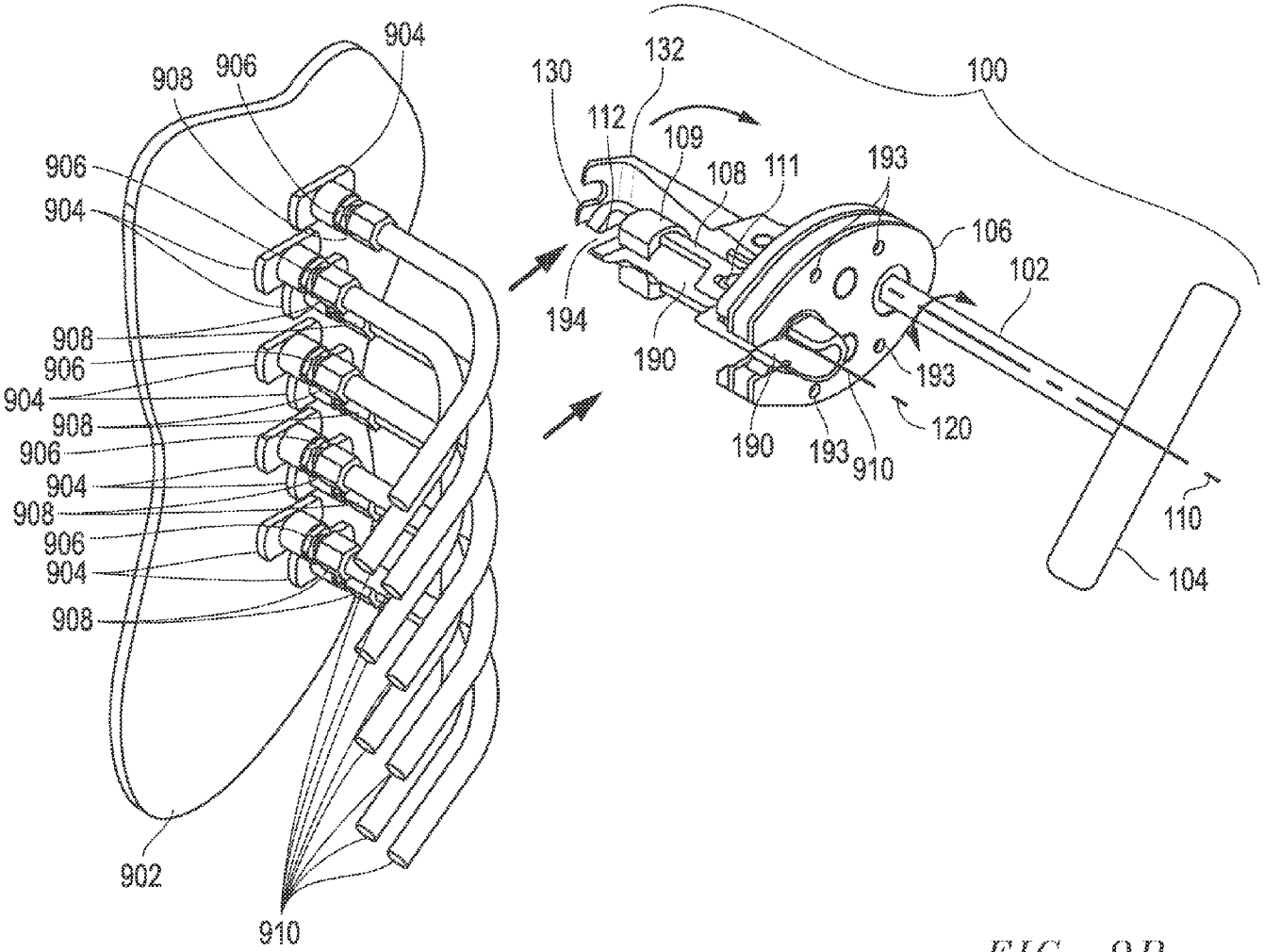
FIG. 9B illustrates a connection and disconnection tool apparatus in a positioned between a first threaded connection and a second threaded connection according to one exemplary embodiment of the disclosed apparatus and methods.
Figure 9C:
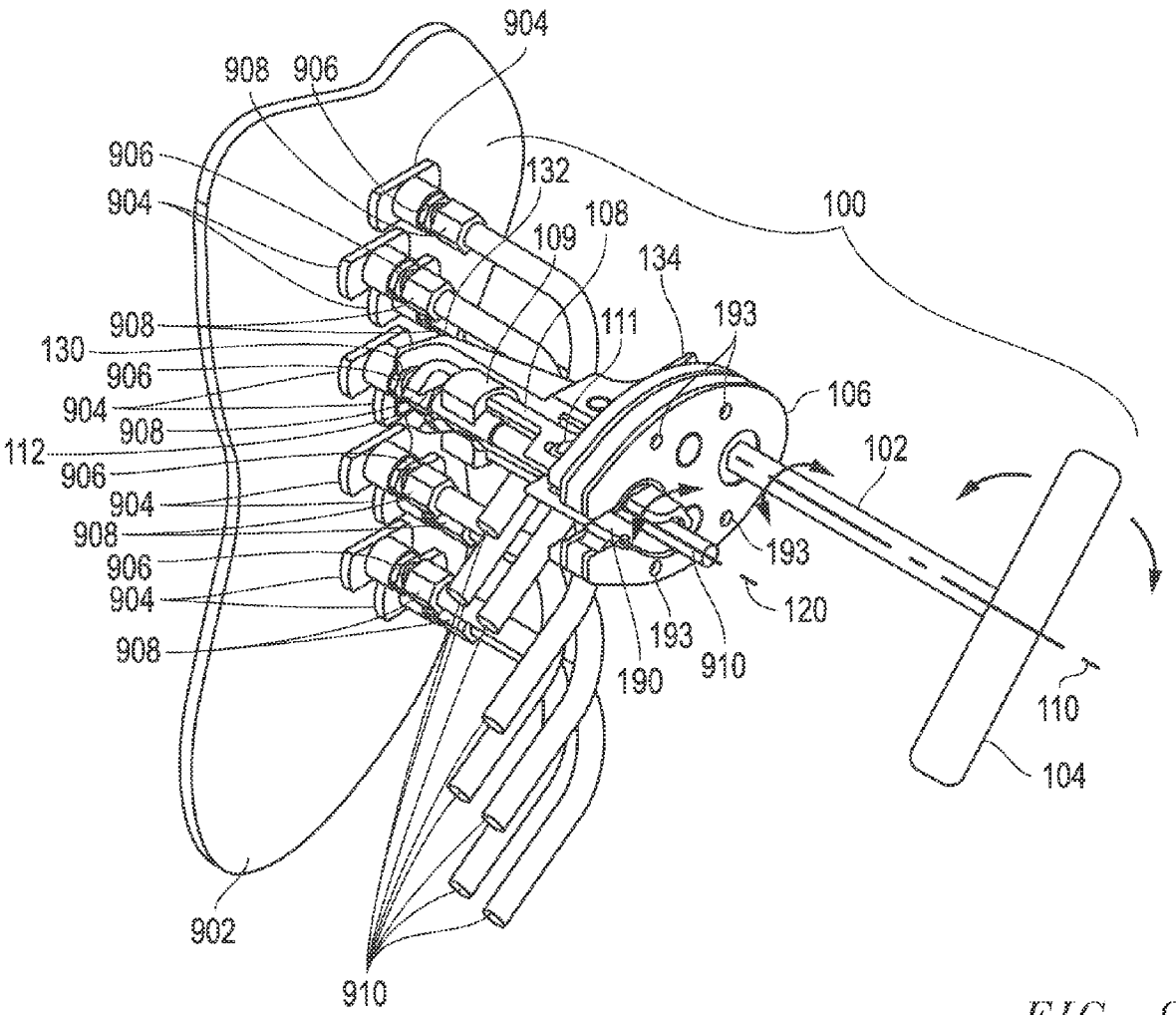
FIG. 9C illustrates a connection and disconnection tool apparatus lockingly engaged with a second threaded connection according to one exemplary embodiment of the disclosed apparatus and methods.

In the illustrated embodiment, the unspread (or relaxed) distance between each pair of jaws 109*a*/109*b* and 111*a*/111*b* is configured to be slightly less than the outside diameter of a cable or tubing segment 910 to be inserted into open pass-through area/s of the connector-drive interface component such that jaws each pair of jaws 109*a*/109*b* and 111*a*/111*b* may be spread slightly apart to admit the cable or tubing segment 910 into pass-through areas 190, 192 and 194 such as is illustrated in FIGS. 9A-9C. However, once a cable or tubing segment 910 is so inserted through jaws 109*a*/109*b* and 111*a*/111*b* into pass-through areas 190, 192 and 194, each pair of jaws 109*a*/109*b* and 111*a*/111*b* may be allowed to relax or spring back together so that the relaxed jaws retain the cable or tubing segment 910 within open pass-through areas 190, 192 and 194 while the first spacer segment 108 is rotated the around a segment of cable or tubing 910. As shown in FIG. 9A this rotation occurs while spanner 112 lockingly engages the first given threaded connector 908 so as to rotate the threaded connector 908 while the segment of cable or tubing 910 extends end-to-end through the entire length of the rotating connector-side components of tool 100 in a position coincident with the connector-side axis of rotation 120, e.g., through each of the pass-through areas of the spacer segment 108 and the offset drive mechanism 106 so as to emerge out the proximal end of extension segment 185 of modular connector-side interface component 165 in the illustrated embodiment. In this assembled relationship, first spacer segment 108 and first spanner 112 may be freely rotated by one or more full revolutions while cable or tubing segment 910 is held clear and retained by relaxed jaw pairs 109*a*/109*b* and 111*a*/111*b* from any interference with the rotation of first spacer segment 108, extension segment 185 and first spanner 112, e.g., without any winding of an attached cable segment 910 around these rotating parts of tool 100.

Figure 8:
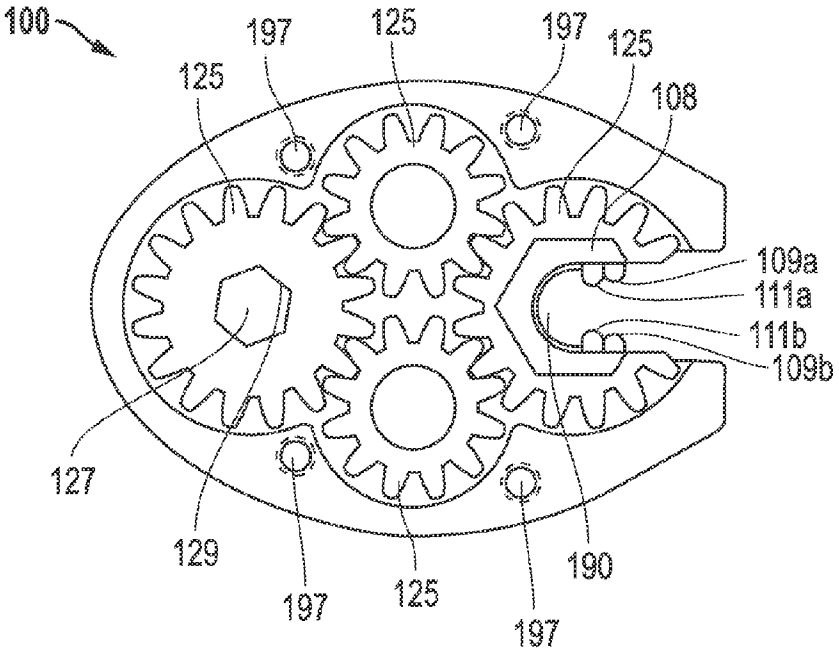
FIG. 8 illustrates a top view of an offset drive mechanism and modular spanner component according to one exemplary embodiment of the disclosed apparatus and methods.
Figure 7:
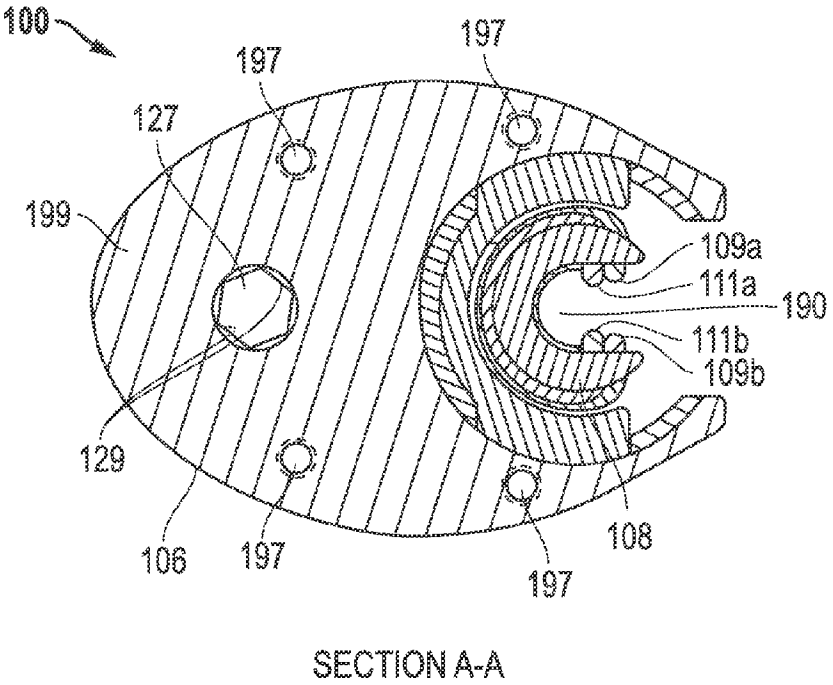
FIG. 7 illustrates a sectional view of a portion of a connection and disconnection tool apparatus according to one exemplary embodiment of the disclosed apparatus and methods.

FIG. 7 illustrates a sectional view AA taken along the line indicated in FIG. 4. FIG. 8 illustrates a top view of connection and disconnection tool apparatus 100 with drive mechanism cover 199 and rotatable handle 104/handle extension member 102 removed to expose internal drive gears 125 of offset drive mechanism 106.

FIGS. 9A-9C illustrate operation of connection and disconnection tool apparatus 100 to tighten and/or loosen successive multiple adjacent threaded connectors 908 that extend in close adjacent spaced relationship from a panel 902, e.g., a connector array having individual threaded connectors 908 spaced apart by about ½ inches to about 1 inches from each other or spaced apart by any other suitable greater or lesser distance particular to a given application. As shown, each of threaded connectors 908 are threaded onto a respective threaded connector assembly 904 that includes a threaded stud that extends from panel 902, with a threaded backup nut 906 beneath each threaded connector 908 that may be present to remain fixed to hold each threaded stud in stationary tightened condition. In the illustrated exemplary embodiment, rotatable handle 104 and handle extension member 102 of the user-side drive interface component may be manually rotated by a user's hand to provide an input rotational motion along the user-side axis of rotation 110 that is translated by the offset drive mechanism 106 to an output rotational motion imparted to the first spanner 112 via first spacer segment 108 (when present) of the connector-side interface component along the connector-side axis of rotation 120 as illustrated by the double-sided arrows in FIG. 9A. As shown in the exemplary embodiment of FIG. 9A, first spanner 112 may rotate by one or more full revolutions in either direction (clockwise or counter-clockwise) together with its first spacer segment 108 around a segment of cable or tubing 910 that is attached to a first given threaded connector 908 that is engaged by the first spanner 112. As shown in FIG. 9A this rotation occurs while spanner 112 lockingly engages the first given threaded connector 908 while the segment of cable or tubing 910 extends coincident with the connector-side axis of rotation 120 through the spacer segment 108 and the offset drive mechanism 106.

As shown in FIG. 9B, connection and disconnection tool apparatus 100 may then be removed by a user from engagement with the first given threaded connector 908, e.g., by pivoting second spacer segment 132 and its second spanner 130 outward about pivot point 136 as shown to facilitate ease of removal of the first spanner 112 from locking engagement with threaded connector 908.

Next, as shown in FIG. 9C, connection and disconnection tool apparatus 100 may then be moved to a second and different one of threaded connectors 908 and positioned so that interior surfaces of first spanner 112 are lockingly engaged with the exterior flat surfaces of second given threaded connector 908 with a segment of cable or tubing 910 attached to the second given threaded connector 908 extending coincident with the connector-side axis of rotation 120 through the spacer segment 108 and the offset drive mechanism 106. This may be done depending on the amount of installation space available around a given threaded connector 908, for example, by placement from the top directly over the second threaded connector 908 and its attached segment of cable or tubing 910, or by insertion from the side on to the second threaded connector 908 and its attached segment of cable or tubing 910, e.g., in either case as needed with second spacer segment 132 and its second spanner 130 pivoted outward as needed about pivot point 136 and/or with second spacer segment 132 rotated together with its second spanner 130 relative to offset drive mechanism 106 and first spanner 112 and first spacer segment 108 as needed to match the clocking of threaded nut 906. In any case, first spanner 112 may then be rotated by one or more full revolutions in either direction (clockwise or counter-clockwise) together with its first spacer segment 108 around the segment of cable or tubing 910 that is attached to the second given threaded connector 908 that is engaged by the first spanner 112 in a similar manner as described above. This process may be repeated to tighten or loosen multiple different threaded connectors 908 from corresponding mating threaded connectors.

While the invention may be adaptable to various modifications and alternative forms, specific examples and exemplary embodiments have been shown by way of example and described herein. However, it should be understood that the invention is not intended to be limited to the particular forms disclosed. Rather, the invention is to cover all modifications, equivalents, and alternatives falling within the spirit and scope of the apparatus and methods described herein. Moreover, the different aspects of the disclosed apparatus and methods may be utilized in various combinations and/or independently. Thus the invention is not limited to only those combinations shown herein, but rather may include other combinations.

What is claimed is:

1. A connection and disconnection tool apparatus, comprising:

an offset drive mechanism including both a connector-side axis of rotation and a user-side axis of rotation, the offset drive mechanism configured to mechanically translate rotational motion from the user-side axis of rotation to the connector-side axis of rotation, the user-side axis of rotation being different than the connector-side axis of rotation;

a user-side drive interface component configured to be coupled to provide an input rotational motion to the user-side axis of rotation of the offset drive mechanism; and a connector-side drive interface component having one or more connector engagement features and configured to be coupled to receive an output rotational motion from the connector-side axis of rotation of the offset drive mechanism and to rotate in response to the received output rotational motion;

where the connector-side drive interface component and the offset drive mechanism each has a side-accessible pass-through area defined therein that includes a peripheral opening contiguous with an axial open portion that is coincident with the connector-side axis of rotation, and where the side-accessible pass-through in each of the connector-side drive interface component and the offset drive mechanism is aligned in the same axis of rotation when being engaged with a connector, the pass-through area of the connector-side drive interface component being configured to be aligned with the pass-through area of the offset drive mechanism; and where the connector-side drive interface component is a modular connector-side drive interface component having the side-accessible pass-through area, and that is configured to be removable from the offset drive mechanism.

2. The apparatus of claim 1, where the connector-side drive interface component comprises a first spanner having interior connector engagement surfaces defined therein, the first spanner being aligned with the connector-side axis of rotation, and the interior connector engagement surfaces being shaped and dimensioned complementary to one or more external surfaces of a threaded connector.

3. The apparatus of claim 2, where the connector-side drive interface component further comprises an elongated first spacer segment configured to be coupled between the offset drive mechanism and the first spanner when the connector-side drive interface component is coupled to receive an output rotational motion from the connector-side axis of rotation of the offset drive mechanism, the first spacer segment being configured to be coupled in alignment with the connector side axis of rotation at a position proximate to the offset drive mechanism to extend along the connector-side axis of rotation away from the offset drive mechanism to the first spanner to hold the first spanner in alignment with the connector-side axis of rotation at a position distal to the offset drive mechanism, and to receive the output rotational motion from the connector-side axis of rotation at the position proximate to the offset drive mechanism and to translate the output rotation motion to the spanner at the position distal to offset drive mechanism.

4. The apparatus of claim 2, further comprising a backup interface component including a second spanner having interior fastener engagement surfaces defined therein that are shaped and dimensioned complementary to one or more external surfaces of a backup fastener, the second spanner being configured to be aligned with the connector-side axis of rotation; and where the second spanner is configured to be disposed adjacent the first spanner on a distal end of the connection and disconnection tool apparatus such that the first spanner is disposed between the second spanner and the offset drive mechanism in alignment with the connector-side axis of rotation.

5. A connection and disconnection tool apparatus, comprising:

an offset drive mechanism including both a connector-side axis of rotation and a user-side axis of rotation, the offset drive mechanism configured to mechanically translate rotational motion from the user-side axis of rotation to the connector-side axis of rotation, the user-side axis of rotation being different than the connector-side axis of rotation:

a user-side drive interface component configured to be coupled to provide an input rotational motion to the user-side axis of rotation of the offset drive mechanism; and a connector-side drive interface component having one or more connector engagement features and configured to be coupled to receive an output rotational motion from the connector-side axis of rotation of the offset drive mechanism and to rotate in response to the received output rotational motion;

where the connector-side drive interface component and the offset drive mechanism each has a side-accessible pass-through area defined therein that includes a peripheral opening contiguous with an axial open portion that is coincident with the connector-side axis rotation, and where the side-accessible pass-through in each of the connector-side drive interface component and the offset drive mechanism is aligned in the same axis of rotation when being engaged with a connector, the pass-through area of the connector-side drive interface component being configured to be aligned with the pass-through area of the offset drive mechanism;

where the connector-side drive interface component comprises a first spanner having interior connector engagement surfaces defined therein, the first spanner being aligned with the connector-side axis of rotation, and the interior connector engagement surfaces being shaped and dimensioned complementary to one or more external surfaces of a threaded connector;

where the apparatus further comprises a backup interface component including a second spanner having interior fastener engagement surfaces defined therein that are shaped and dimensioned complementary to one or more external surfaces of a backup fastener, the second spanner being configured to be aligned with the connector-side axis of rotation; and where the second spanner is configured to be disposed adjacent the first spanner on a distal end of the connection and disconnection tool apparatus such that the first spanner is disposed between the second spanner and the offset drive mechanism in alignment with the connector-side axis of rotation;

where the connector-side drive interface component further comprises an elongated first spacer segment configured to be coupled between the offset drive mechanism and the first spanner when the connector-side drive interface component is coupled to receive an output rotational motion from the connector-side axis of rotation of the offset drive mechanism, the first spacer segment being configured to be coupled in alignment with the connector side axis of rotation at a position proximate to the offset drive mechanism to extend along the connector-side axis of rotation away from the offset drive mechanism to the first spanner to hold the first spanner in alignment with the connector-side axis of rotation at a position distal to the offset drive mechanism, and to receive the output rotational motion from the connector-side axis of rotation at the position proximate to the offset drive mechanism and to translate the output rotation motion to the first spanner at the position distal to offset drive mechanism; and where the backup interface component further comprises an elongated second spacer segment coupled between the offset drive mechanism and the second spanner, the second spacer segment extending from the offset drive mechanism in adjacent side-by-side relationship to an installed position of the first spacer and first spanner so as to hold the second spanner in alignment with the connector-side axis of rotation with the first spanner positioned between the second spanner and the offset drive mechanism and to prevent the second spanner from rotating with the first spanner in response to the received output rotational motion from the offset drive mechanism; and where the second spacer and the second spanner are configured to pivot outward and away from the first spacer and the first spanner to remove the second spanner from alignment with the connector-side axis of rotation.

6. The apparatus of claim 4, where the backup interface component further comprises a second spacer segment coupled between the offset drive mechanism and the second spanner, the second spacer and the second spanner being configured to rotate together relative to the offset drive mechanism and at least partially around the connector side axis of rotation.

7. The apparatus of claim 2, where the connector-side drive interface component is a modular connector-side drive interface component that is configured to be removable from the offset drive mechanism; and where the offset drive mechanism is configured to be coupled to provide an output rotational motion to different interchangeable modular connector-side drive interface components having different dimensioned and/or shaped interior connector engagement surfaces that are configured to lockingly engage threaded connector members having different outside dimensions and/or shapes, each of the modular connector-side drive interface components having a side-accessible pass-through area defined therein that includes a peripheral opening contiguous with an axial open portion and that is configured to be aligned with the pass-through area of the offset drive mechanism when the modular connector-side drive interface component is coupled to receive an output rotational motion from the connector-side axis of rotation of the offset drive mechanism.

8. The apparatus of claim 1, where the user-side axis of rotation is parallel to the connector-side axis of rotation.

9. The apparatus of claim 1, where the offset drive mechanism comprises a gear system that includes multiple gears.

10. The apparatus of claim 1, where the user-side drive interface component comprises a rotatable handle.

11. The apparatus of claim 1, where the connector engagement features of the connector-side drive interface are configured to lockingly engage an exterior profile of a threaded connector so as to hold the threaded connector as the connector-side drive interface is rotated by the rotational motion received from the offset drive mechanism so as to impart rotation to the threaded connector while a cable or tubing segment that is attached to the threaded connector is received in a position coincident with the connector-side axis of rotation within the side-accessible pass-through openings of the connector-side drive interface component and the offset drive mechanism without any mechanical interference between the cable or tubing segment and either of the connector-side drive interface component and the offset drive mechanism while the connector-side drive interface component rotates the threaded connector by at least one full revolution.

12. A connection and disconnection tool apparatus, comprising:

an offset drive mechanism including both a connector-side axis of rotation and a user-side axis of rotation, the offset drive mechanism configured to mechanically translate rotational motion from the user-side axis of rotation to the connector-side axis of rotation, the user-side axis of rotation being different than the connector-side axis of rotation;

a user-side drive interface component configured to be coupled to provide an input rotational motion to the user-side axis of rotation of the offset drive mechanism; and a connector-side drive interface component having one or more connector engagement features and configured to be coupled to receive an output rotational motion from the connector-side axis of rotation of the offset drive mechanism and to rotate in response to the received output rotational motion;

where the connector-side drive interface component and the offset drive mechanism each has a side-accessible pass-through area defined therein that includes a peripheral opening contiguous with an axial open portion that is coincident with the connector-side axis of rotation, and where the side-accessible pass-through in each of the connector-side drive interface component and the offset drive mechanism is aligned in the same axis of rotation when being engaged with a connector, the pass-through area of the connector-side drive interface component being configured to be aligned with the pass-through area of the offset drive mechanism;

where the connector engagement features of the connector-side drive interface are configured to lockingly engage an exterior profile of a threaded connector so as to hold the threaded connector as the connector-side drive interface is rotated by the rotational motion received from the offset drive mechanism so as to impart rotation to the threaded connector while a cable or tubing segment that is attached to the threaded connector is received in a position coincident with the connector-side axis of rotation within the side-accessible pass-through openings of the connector-side drive interface component and the offset drive mechanism without any mechanical interference between the cable or tubing segment and either of the connector-side drive interface component and the offset drive mechanism while the connector-side drive interface component rotates the threaded connector by at least one full revolution; and where the apparatus further comprises at least one cable or tubing retention feature that defines a spreadable retainer opening that is aligned with a peripheral opening of the pass-through area of the connector-side drive interface, the retainer opening being configured to be spread wider to selectably allow the segment of cable or tubing to be inserted into a position coincident with the connector-side axis of rotation within the side-accessible pass-through opening of the connector-side drive interface component and to then narrow to prevent the segment of cable or tubing to be removed from the inserted position so as to retain the segment of cable or tubing in the inserted position coincident with the connector-side axis of rotation within the side-accessible pass-through opening of the connector-side drive interface component.

13. A method of rotating a threaded connector having an attached cable or tubing segment, comprising performing the following steps using the connection and disconnection tool apparatus of claim 1:

lockingly engaging a connector-side drive interface component of the connection and disconnection tool apparatus to the threaded connector having one or more connector engagement features;

rotating the user-side drive interface component of the connection and disconnection tool apparatus to provide an input rotational motion to a user-side axis of rotation of an offset drive mechanism of the connection and disconnection tool apparatus;

mechanically translating rotational motion in the offset drive mechanism from the user-side axis of rotation to a connector-side axis of rotation, the user-side axis of rotation being different than the connector-side axis of rotation; and receiving an output rotational motion from the connector-side axis of rotation of the offset drive mechanism to cause the connector-side drive interface component to rotate the threaded connector in response to the received output rotational motion;

where the method further comprises:

placing the attached cable or tubing segment of the threaded connector into a position coincident with the connector-side axis of rotation within the axial open portion of the side-accessible pass-through area defined in the connector-side drive interface component and the axial open portion of the side-accessible pass-through area defined in the offset drive mechanism by passing the attached cable or tubing segment through the respective peripheral opening that is contiguous with the axial open portion of each of the side-accessible pass-through areas of each of the connector-side drive interface component and the offset drive mechanism, the pass-through area of the connector-side drive interface component being aligned with the pass-through area of the offset drive mechanism, and causing the connector-side drive interface component to rotate the threaded connector in response to the received output rotational motion while the cable or tubing segment is received in the position coincident with the connector-side axis of rotation within the side-accessible pass-through openings of the connector-side drive interface component and the offset drive mechanism.

14. The method of claim 13, further comprising causing the connector-side drive interface component to rotate the threaded connector at least one full revolution in response to the received output rotational motion while the cable or tubing segment is received in the position coincident with the connector-side axis of rotation within the side-accessible pass-through openings of the connector-side drive interface component and the offset drive mechanism without any mechanical interference between the cable or tubing segment and either of the connector-side drive interface component and the offset drive mechanism.

15. The method of claim 13, where the connector-side drive interface component comprises:

a first spanner; and a first spacer segment coupled between the offset drive mechanism and the first spanner while the connector-side drive interface component is receiving an output rotational motion from the connector-side axis of rotation of the offset drive mechanism;

where the one or more connector engagement features comprise interior connector engagement surfaces defined within the first spanner that are shaped and dimensioned complementary to one or more external surfaces of the threaded connector, the first spanner being aligned with the connector-side axis of rotation.

16. The method of claim 15, further comprising lockingly engaging interior fastener engagement surfaces of a second spanner of a backup interface component of the connection and disconnection tool apparatus to one or more external surfaces of a backup fastener disposed axially aligned beneath the threaded connector at the same time as lockingly engaging the connector-side drive interface component of the connection and disconnection tool apparatus to the threaded connector; and using the second spanner to prevent the backup fastener from rotating while receiving the output rotational motion from the connector-side axis of rotation of the offset drive mechanism to cause the connector-side drive interface component to rotate.

17. The method of claim 16, where the backup interface component further comprises a second spacer segment pivotably coupled between the offset drive mechanism and the second spanner; and where the method further comprises pivoting the second spacer and the second spanner outward and away from the first spacer and the first spanner while lockingly engaging the connector-side drive interface component of the connection and disconnection tool apparatus to the threaded connector or disengaging the connector-side drive interface component of the connection and disconnection tool apparatus from the threaded connector.

18. The method of claim 16, where the backup interface component further comprises a second spacer segment pivotably coupled between the offset drive mechanism and the second spanner; and where the method further comprises rotating the second spacer and the second spanner relative to the offset drive mechanism and at least partially around the connector side axis of rotation while lockingly engaging the connector-side drive interface component of the connection and disconnection tool apparatus to the threaded connector or disengaging the connector-side drive interface component of the connection and disconnection tool apparatus from the threaded connector.

19. The method of claim 15, where the connector-side drive interface component is a first modular connector-side drive interface component; and where the method further comprises:

removing a second modular connector-side drive interface component from the offset drive mechanism; and then coupling the first modular connector-side drive interface component to the offset drive mechanism prior to the step of lockingly engaging the first modular connector-side drive interface component to the threaded connector;

where the first modular connector-side drive interface component has different dimensioned and/or shaped interior connector engagement surfaces than the interior connector engagement surfaces of the second modular connector-side drive interface component so as to lockingly engage threaded connector members having different outside dimensions and/or shapes.

20. The apparatus of claim 1, where the user-side drive interface component includes a first spanner coupled to provide an input rotational motion to the user-side axis of rotation of the offset drive mechanism, the first spanner having interior connector engagement surfaces defined therein, the first spanner being aligned with the connector-side axis of rotation, and the interior connector engagement surfaces being shaped and dimensioned complementary to one or more external surfaces of a threaded connector;

where the connector-side drive interface component further comprises a first spacer segment coupled between the offset drive mechanism and the first spanner, the first spacer segment being coupled to receive the output rotational motion from the connector-side axis of rotation of the offset drive mechanism and to transfer the output rotational motion to the first spacer; and where the connector engagement features of the connector-side drive interface are configured to lockingly engage an exterior profile of a threaded connector so as to hold the threaded connector as the connector-side drive interface is rotated by the rotational motion received from the offset drive mechanism so as to impart rotation to the threaded connector while a cable or tubing segment that is attached to the threaded connector is received in a position coincident with the connector-side axis of rotation within the side-accessible pass-through openings of the connector-side drive interface component and the offset drive mechanism.

21. The apparatus of claim 20, further comprising a backup interface component including a second spanner and a second spacer segment coupled between the offset drive mechanism and the second spanner, the second spanner having interior fastener engagement surfaces defined therein that are shaped and dimensioned complementary to one or more external surfaces of a backup fastener, the second spanner being aligned with the connector-side axis of rotation; and where the second spanner is disposed adjacent the first spanner on a distal end of the connection and disconnection tool apparatus such that the first spanner is disposed between the second spanner and the offset drive mechanism in alignment with the connector-side axis of rotation.

22. The apparatus of claim 21, where the second spanner is configured to pivot outward and away from the first spacer and the first spanner; and where the second spacer and the second spanner are configured to rotate together relative to the offset drive mechanism and at least partially around the connector side axis of rotation.

23. The apparatus of claim 20, further comprising at least one cable or tubing retention feature having a retainer opening that is defined between spreadable jaws and aligned with a peripheral opening of the pass-through area of the connector-side drive interface, the spreadable jaws of the cable or tubing retention feature being configured to spread apart to allow the segment of cable or tubing to be inserted into a position coincident with the connector-side axis of rotation within the side-accessible pass-through opening of the connector-side drive interface component and to then contract toward each other to retain the segment of cable or tubing in the inserted position coincident with the connector-side axis of rotation within the side-accessible pass-through opening of the connector-side drive interface component.

24. The apparatus of claim 5, where the connector-side drive interface component is configured to be removable from the offset drive mechanism in a direction away from the offset drive mechanism that is parallel and coincident with the connector-side axis of rotation; where the second spanner prevents removal of the connector-side drive interface component from the offset drive mechanism when the second spacer segment holds the second spanner in alignment with the connector-side axis of rotation; and where the where the second spacer segment and second spanner are configured to pivot outward and away from the first spacer and the first spanner to remove the second spanner from alignment with the connector-side axis of rotation so as to allow the removal of the connector-side drive interface component from the offset drive mechanism.

25. The apparatus of claim 5, further comprising a lock coupled to prevent the second spacer segment and second spanner from rotating together relative to the offset drive mechanism, the lock being configured to selectably allow the second spacer segment and second spanner to rotate together relative to the offset drive mechanism to match the clocking of a fastener that may be positioned in-line and beneath a threaded connector of a cable or tubing segment received in a position coincident with the connector-side axis of rotation within the side-accessible pass-through openings of the connector-side drive interface component and the offset drive mechanism.

26. The apparatus of claim 12, where the cable or tubing retention feature comprises a spring.

* * * * *